US011738911B2

(12) United States Patent
Falzoni

(10) Patent No.: US 11,738,911 B2
(45) Date of Patent: Aug. 29, 2023

(54) CAP FOR A CONTAINER, AND A COMBINATION OF A CAP AND OF A CONTAINER NECK

(71) Applicant: SACMI COOPERATIVA MECCANICI IMOLA SOCIETA' COOPERATIVA, Imola (IT)

(72) Inventor: Alessandro Falzoni, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 0 days.

(21) Appl. No.: 17/595,905

(22) PCT Filed: Jun. 1, 2020

(86) PCT No.: PCT/IB2020/055158
§ 371 (c)(1),
(2) Date: Nov. 29, 2021

(87) PCT Pub. No.: WO2020/240518
PCT Pub. Date: Dec. 3, 2020

(65) Prior Publication Data

US 2022/0289434 A1 Sep. 15, 2022

(30) Foreign Application Priority Data

May 31, 2019 (IT) ..... 102019000007809

(51) Int. Cl.
*B65D 41/34* (2006.01)
*B65D 41/32* (2006.01)
*B65D 55/16* (2006.01)

(52) U.S. Cl.
CPC ..... *B65D 41/3428* (2013.01); *B65D 41/325* (2013.01); *B65D 41/3447* (2013.01); *B65D 55/16* (2013.01); *B65D 2401/30* (2020.05)

(58) Field of Classification Search
CPC ..... B65D 41/3428; B65D 41/3423; B65D 41/325; B65D 41/32; B65D 41/3447; B65D 41/3442; B65D 55/16; B65D 1/0238
(Continued)

(56) References Cited

U.S. PATENT DOCUMENTS 4,394,918 A * 7/1983 Grussen ..... B65D 41/3428 215/253
9,643,762 B2 5/2017 Maguire
(Continued)

FOREIGN PATENT DOCUMENTS

CA 2210633 A1 * 8/1996 ..... B65D 55/16
JP 3306733 B2 * 7/2002 ..... B65D 41/3428
KR 101038894 B1 6/2011

*Primary Examiner* — Robert J Hicks
(74) *Attorney, Agent, or Firm* — Pearne & Gordon LLP; J. Gregory Chrisman

(57) ABSTRACT

A cap for a container comprises:
- a retaining ring intended to remain associated with a neck of the container;
- a closing element movable between a closed position and an open position;
- at least one connecting band for keeping the closing element connected to the retaining ring even in the open position.

The retaining ring comprises engaging members suitable for engaging with the neck in order to prevent the retaining ring from being pulled off the neck. The engaging members comprise first engaging elements and second engaging elements which extend towards the inside of the retaining ring. The first engaging elements have a shape different from the second engaging elements, so as to be in contact with the neck in the open position, in order to obstruct rotation of the retaining ring around the neck.

19 Claims, 5 Drawing Sheets

(58) Field of Classification Search
USPC ..... 215/252, 253, 250, 306; 220/276, 266, 220/265, 375
See application file for complete search history.

(56) References Cited

U.S. PATENT DOCUMENTS

| | | | | |
|---|---|---|---|---|
| 2001/0002661 | A1 | 6/2001 | Reidenbach | |
| 2004/0232100 | A1 | 11/2004 | Reidenbach | |
| 2012/0285921 | A1 | 11/2012 | Kwon | |
| 2016/0288961 | A1 | 10/2016 | Maguire | |
| 2017/0166360 | A1* | 6/2017 | Falzoni | B65D 41/0435 |
| 2017/0203896 | A1 | 7/2017 | Maguire | |
| 2017/0362003 | A1 | 12/2017 | Maguire | |
| 2018/0079570 | A1 | 3/2018 | Maguire | |
| 2022/0169423 | A1* | 6/2022 | Lohrman | B65D 55/16 |

* cited by examiner

Fig.1
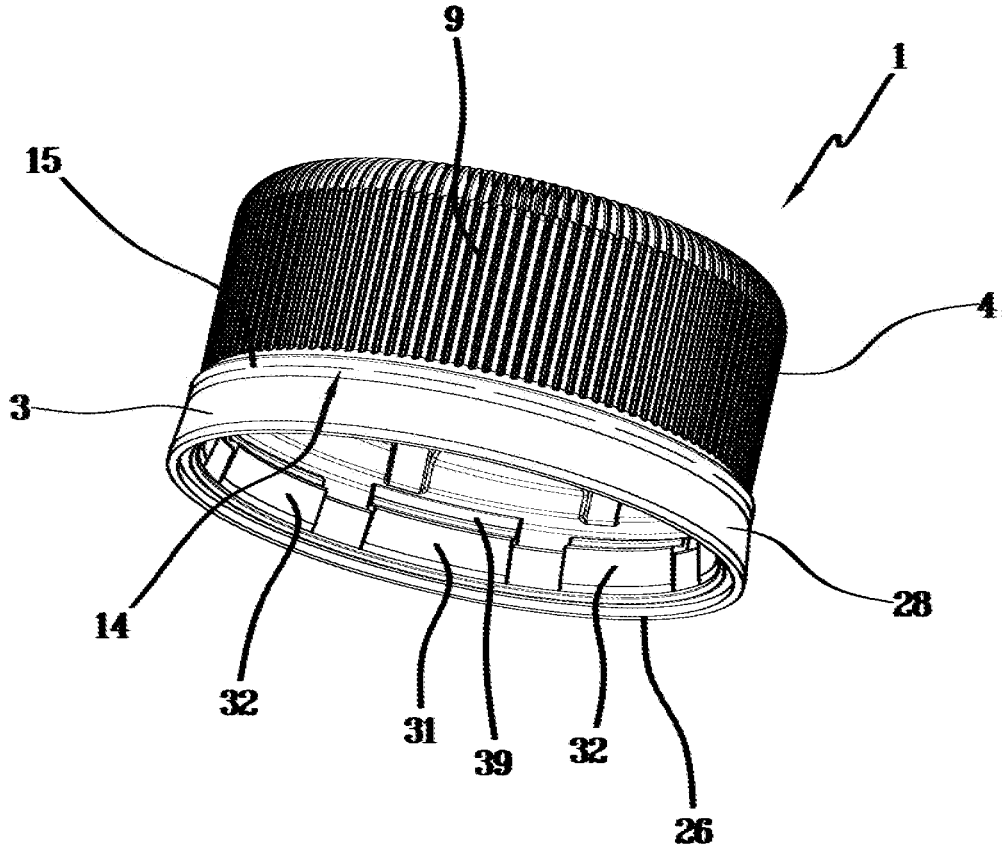
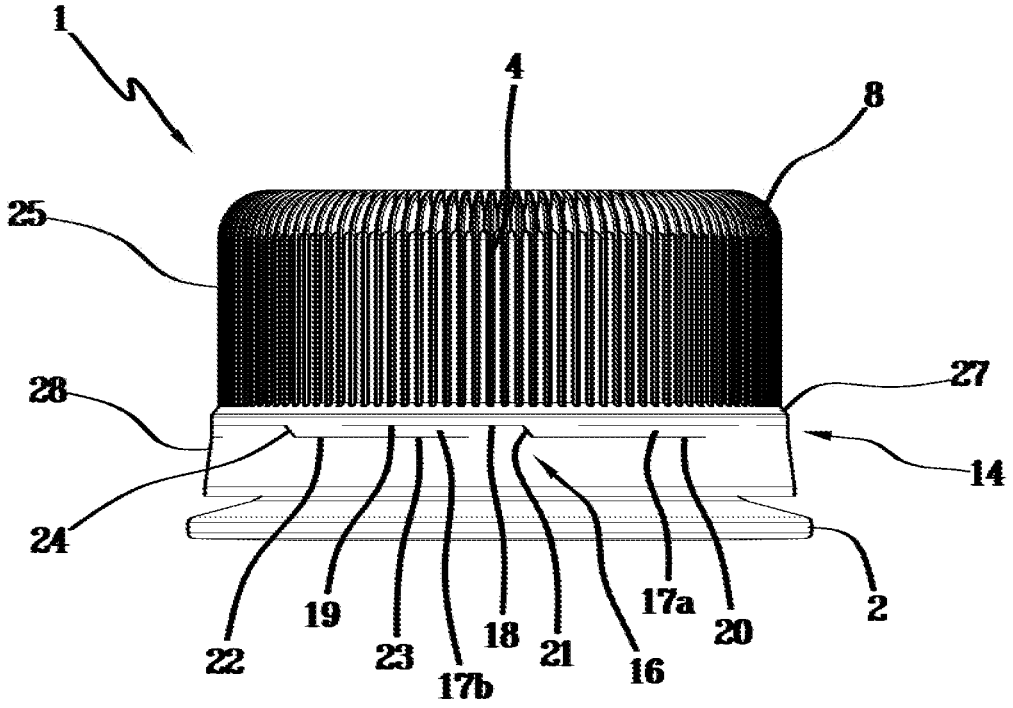
Fig.2

Fig.4
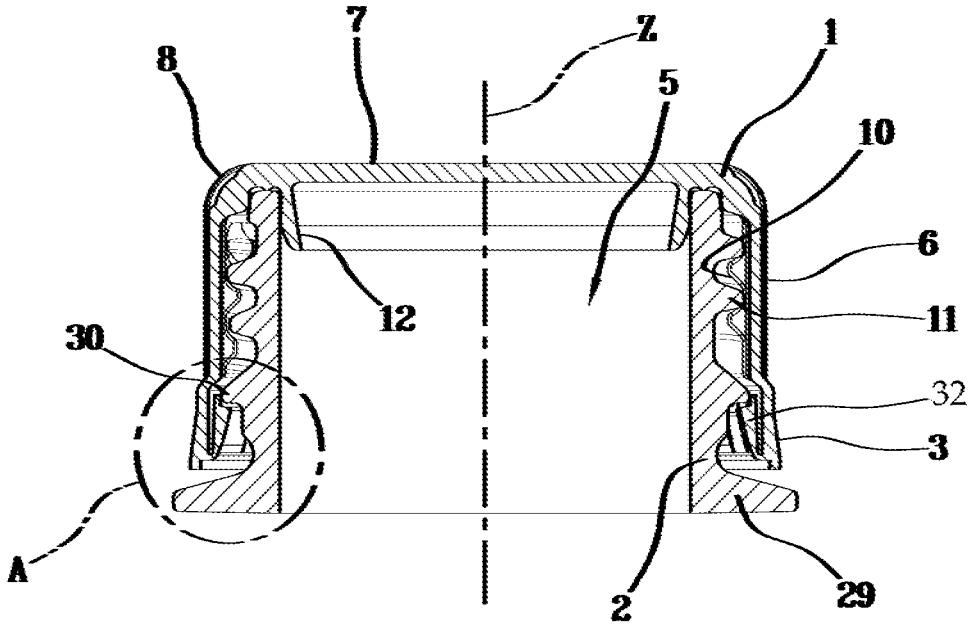
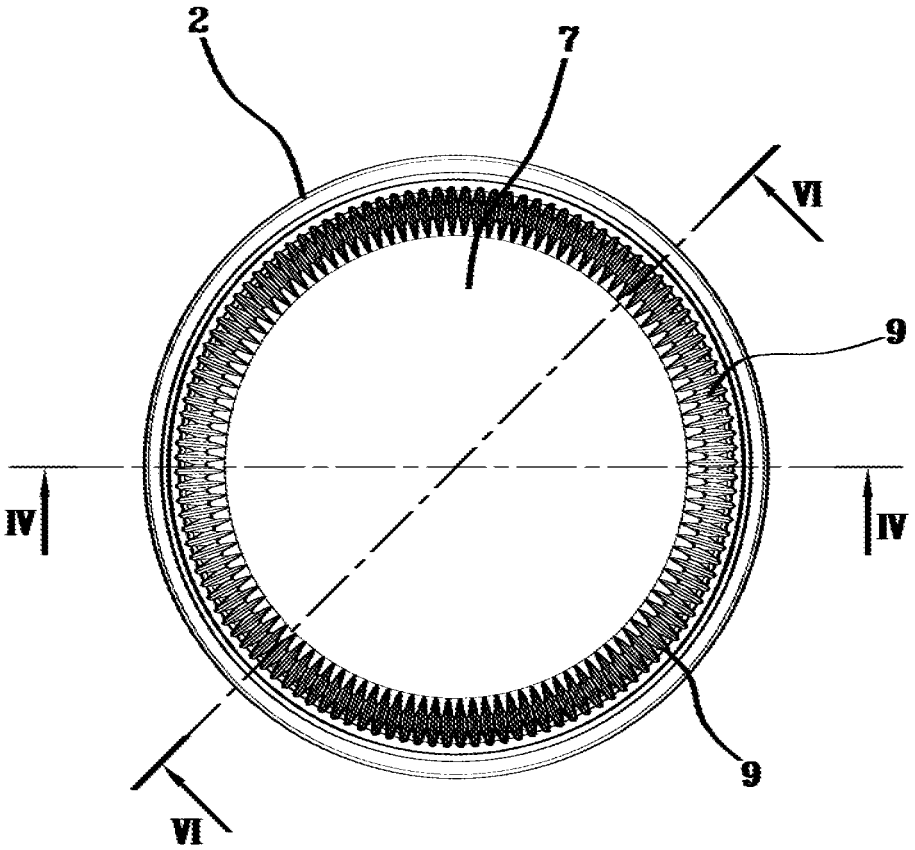
Fig.3

Fig.7
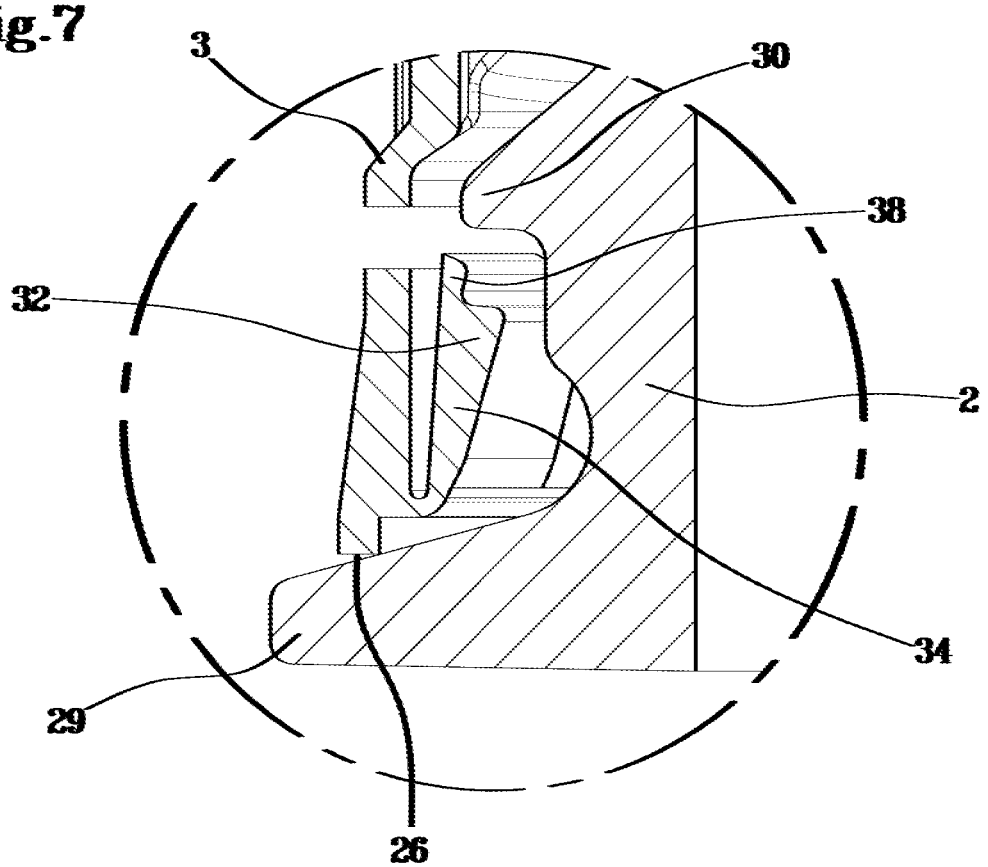
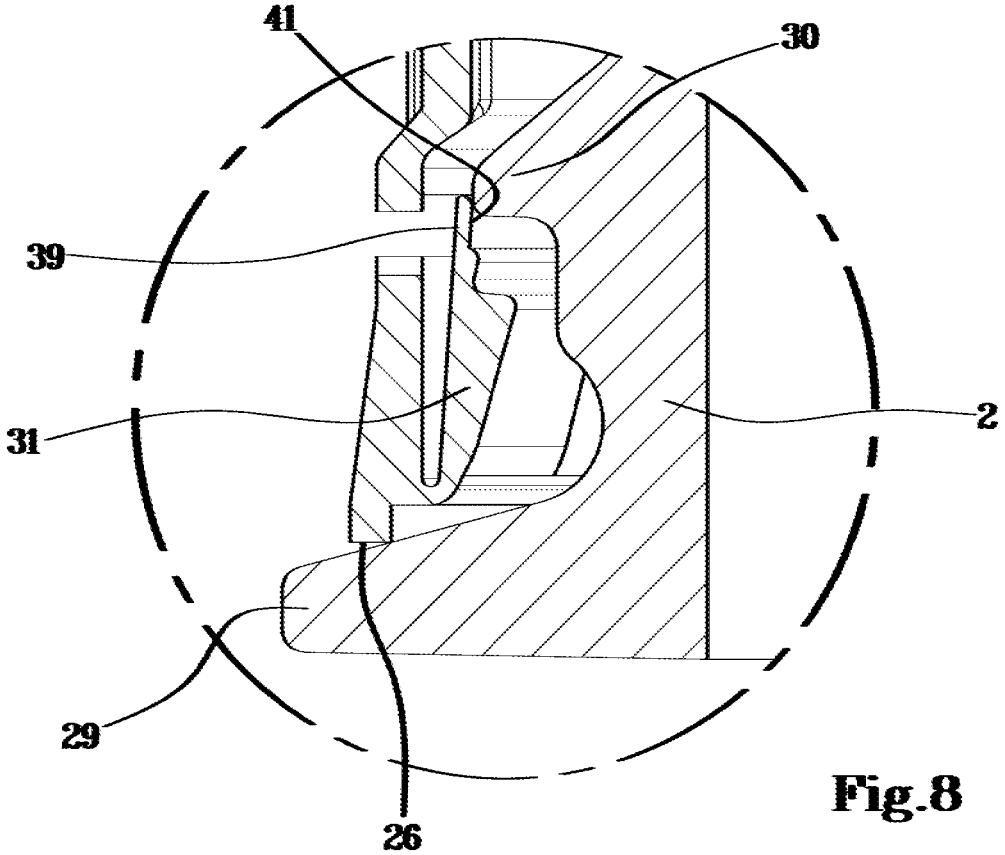
Fig.8

Fig.9
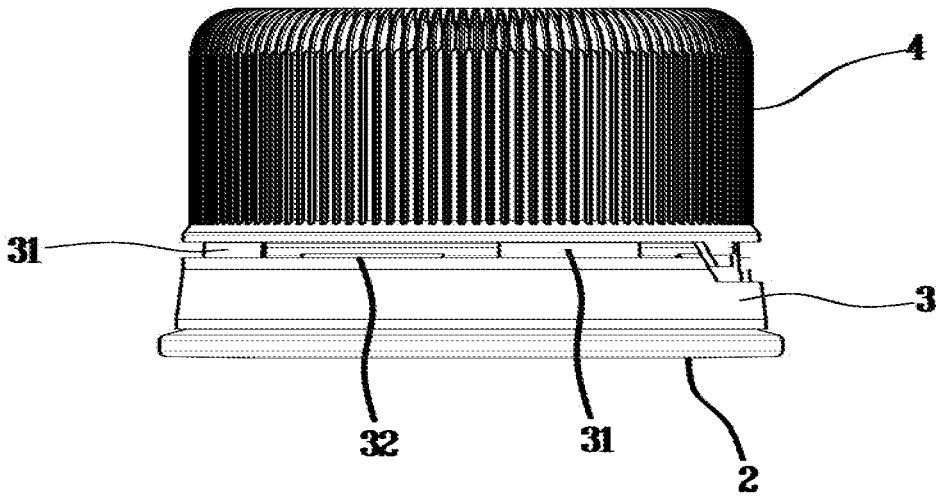
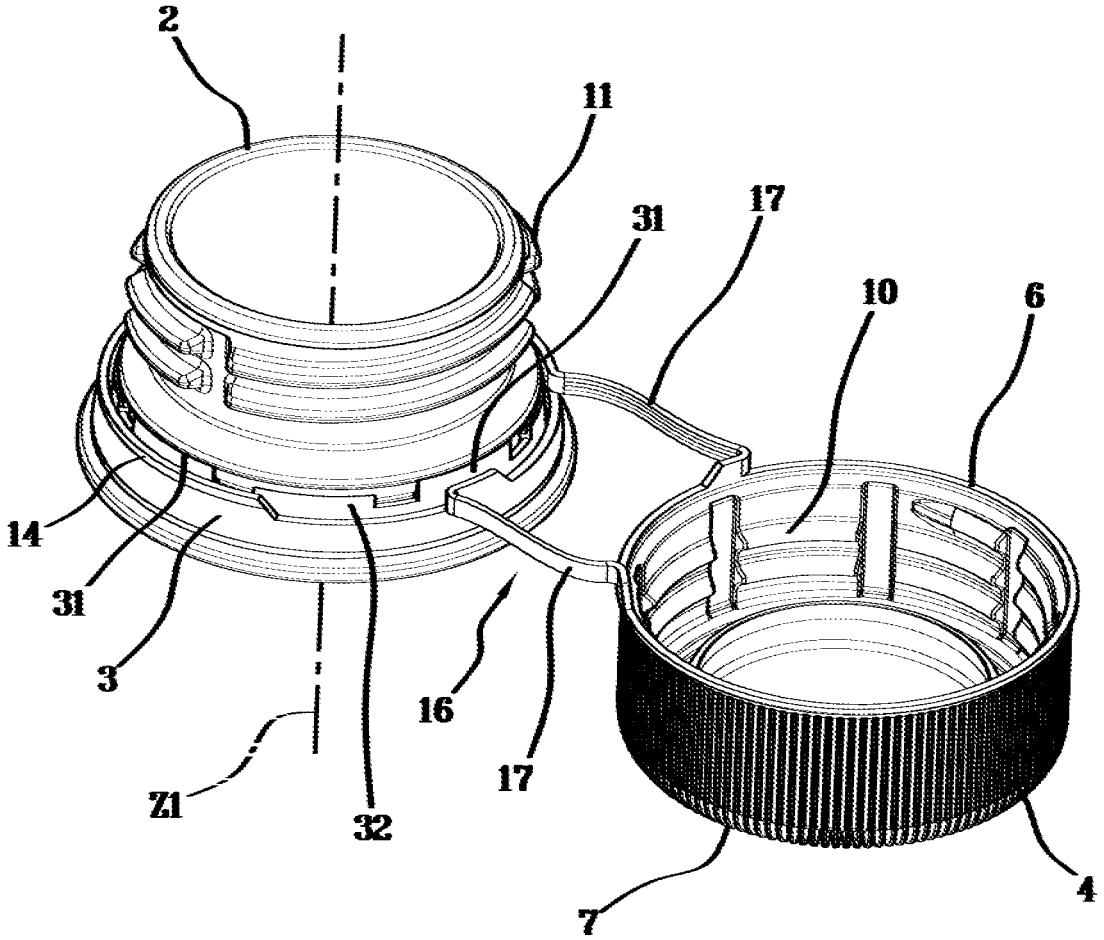
Fig.10

CAP FOR A CONTAINER, AND A COMBINATION OF A CAP AND OF A CONTAINER NECK

The invention relates to a cap for a container, in particular a cap provided with a retaining ring, that can be associated with a container neck, the cap being further provided with a closing element which, after opening, remains connected to the retaining ring. The cap according to the invention is particularly, but not exclusively, suitable for applying on bottles intended to contain liquid substances.

The invention further relates to a combination of a cap for a container and of a container neck.

Caps for bottles are known, which comprise a cup-shaped body provided with an inner thread suitable for engaging with an outer thread of a neck of the bottle. The known caps are further provided with a tamper-evident ring connected to the cup-shaped body by a plurality of breakable bridges. When the cap is opened for the first time, the cup-shaped body separates from the tamper-evident ring following breakage of the breakable bridges. The tamper-evident ring remains associated with the neck of the bottle, whilst the cup-shaped body may be unscrewed by the user, who thereby separates the cup-shaped body from the bottle to access the contents of the bottle. Then, the cup-shaped body may be screwed back onto the neck in order to close the bottle again.

It happens sometimes that, after the bottle has been emptied, the user throws the cup-shaped body on the ground, intentionally or by accident, whilst the bottle, together with the tamper-evident ring associated with it, is correctly thrown in a waste bin.

In order to prevent that from happening, caps have been proposed which are provided with a retaining ring, that can be associated with a neck of a bottle, and a closing element, connected to the retaining ring by a hinge. The closing element may be rotated around the hinge between an open position, in which a user can access the contents of the bottle, and a closed position, in which the closing element prevents access to the bottle. The hinge keeps the closing element associated with the retaining ring and therefore with the bottle, preventing the possibility of the closing element being thrown on the ground independently of the botte.

One example of a cap with hinge of the type referred to above is disclosed in U.S. Pat. No. 9,643,762. That patent discloses a cap comprising a tamper-evident ring intended to remain associated with a neck of a bottle, and a cup-shaped body connected to the tamper-evident ring by a plurality of breakable elements arranged along a first incision line. The cup-shaped body is also connected to the tamper-evident ring by two connecting portions defined between the first incision line and one or more second incision lines. The cup-shaped body is provided with an inner thread, so as to engage with an outer thread made on the neck of the bottle.

When the cup-shaped body has been unscrewed from the neck and brought into an open position, the tamper-evident ring, which remained associated with the neck, is free to rotate around the neck itself. Therefore, while a user is drinking a liquid contained in the bottle from the neck of the latter, or is pouring the liquid contained in the bottle into a glass, the cup-shaped body may rotate about the neck due to the force of gravity, depending on the angular position of the cup-shaped body around the neck at that moment. If that happens, the cup-shaped body may strike the face of the user who is drinking, or be interposed between the neck of the bottle and the glass, which obstructs the supply of the liquid into the glass.

Other examples of known caps are disclosed in US 2012/285921, KR 101038894, US 2001/002661.

An object of the invention is to improve the known caps, particularly the caps comprising a retaining ring intended to remain associated with a neck of the container and a closing element connected to the retaining ring by at least one connecting band, so that the closing element is movable between an open position and a closed position.

Another object is to provide a cap for a container in which, in the open position, there is a reduction of the risks that the closing element will accidentally strike the face of the user or obstruct the supply of a substance contained in the container into a glass or the like.

A further object is to provide a cap for a container, of the type mentioned above, which can be easily produced.

In a first aspect of the invention, there is provided a cap for a container, comprising:

- a retaining ring intended to remain associated with a neck of the container;
- a closing element movable between a closed position and an open position;
- at least one connecting band for keeping the closing element connected to the retaining ring even in the open position;

wherein the retaining ring comprises engaging members suitable for engaging with the neck in order to prevent the retaining ring from being pulled off the neck, the engaging members comprising first engaging elements and second engaging elements which extend towards the inside of the retaining ring, the first engaging elements having a shape different from the second engaging elements, so as to be in contact with the neck in the open position, in order to obstruct rotation of the retaining ring around the neck.

Owing to the second engaging elements, which have a shape different from the first engaging elements and are in contact with the neck in the open position, it is possible to effectively obstruct rotation of the retaining ring, and consequently of the closing element connected to it, around the neck of the container. Indeed, the first engaging elements couple by friction to the neck of the container when the closing element is in the open position. That makes it more difficult, for the retaining ring, to freely rotate around the neck of the container. Rotation of the closing element, which is connected to the retaining ring, is also consequently obstructed. In this way, there is a reduction in the risks that, when the user moves the neck of the container near to his or her mouth in order to drink directly from the container, the closing element may rotate until it strikes the face of the user. Similarly, there is a reduction in the risks that, if the container is used for pouring a liquid contained in it into a glass or the like, the closing element may rotate into an unwanted position interposed between the glass and the flow of liquid which is being poured.

The second engaging elements may be configured to remain at a distance from the neck in the open position. That prevents the development between the retaining ring and the neck of the container of excessive friction, which could have negative consequences.

The first engaging elements may comprise at least one first engaging element.

The second engaging elements may comprise at least one second engaging element.

In one embodiment, the first engaging element extends from the retaining ring towards the closing element more than the second engaging element.

In this way, in the open position the first engaging element can engage by friction with the neck of the container, whilst—in the same position—the second engaging element does not touch the neck of the container.

In particular, in the open position the first engaging element is configured to be in contact with an annular protuberance of the neck of the container. Between the annular protuberance of the neck and the first engaging element, in the open position, a friction is generated which opposes rotation of the retaining ring around the neck.

In one embodiment, the first engaging element comprises a retaining portion having an abutment surface suitable for making contact with an annular protuberance of the neck before the closing element is brought into the open position for the first time, in order to prevent the retaining ring from being pulled off the neck.

In particular, the abutment surface may be configured to engage with a surface of the annular protuberance of the neck facing towards a body of the container.

The retaining portion may have a cross-section which is substantially shaped like an inverted triangle.

In one embodiment, the first engaging element comprises a centring portion which extends from the retaining portion towards the closing element.

The centring portion may be configured to engage with the neck, in particular with the annular protuberance, before the closing element is brought into the open position for the first time, so as to keep the retaining ring centred relative to the neck.

In one embodiment, the first engaging element comprises an anti-rotation appendage arranged in a position nearer to the closing element than the retaining portion.

The anti-rotation appendage may in particular be configured to engage with the annular protuberance of the neck along a maximum diameter zone of the annular protuberance.

The anti-rotation appendage may extend from the centring portion towards the closing element.

In one embodiment, the second engaging element comprises a retaining portion and if necessary a centring portion, which may be the same as the corresponding portions of the first engaging element.

In contrast, the second engaging element does not have the anti-rotation appendage.

In one embodiment, the first engaging element and the second engaging element are shaped as respective tabs which extend from an edge region of the retaining ring arranged at the opposite side of the retaining ring relative to the closing element, said respective tabs being bent towards the closing element inside the retaining ring.

That makes the first engaging element and the second engaging element easy to make, because it is possible to produce them using moulds similar to those which are used for making the traditional caps whose retaining ring is provided with bent tabs.

In one embodiment, the first engaging elements comprise a plurality of first engaging elements, distributed around a central axis of the retaining ring.

The second engaging elements may comprise a plurality of second engaging elements, distributed around the central axis of the retaining ring. By providing a plurality of first engaging elements, it is possible to effectively avoid rotation of the retaining ring around the neck. The first engaging elements interact with the neck in the open position, thereby generating a friction that opposes to rotation of the retaining ring in a plurality of zones distributed around the central axis. This allows the retaining ring to be kept stably stationary in a predetermined angular position.

In a second aspect of the invention, there is provided a combination of a cap for a container and of a container neck, wherein the cap comprises:

- a retaining ring intended to remain associated with the neck;
- a closing element movable between a closed position and an open position;
- at least one connecting band for keeping the closing element connected to the retaining ring even in the open position;

and wherein the retaining ring comprises engaging members suitable for engaging with the neck in order to prevent the retaining ring from being pulled off the neck, at least one of the engaging members being configured to engage with the neck by friction in the open position.

The engaging members obstruct rotation of the retaining ring, and consequently of the closing element connected to the retaining ring, around the neck.

Indeed, the friction which develops between the neck and the engaging members only makes rotation of the retaining ring around the neck possible if sufficient force is applied to the cap. The simple force of gravity does not allow the retaining ring to rotate around the neck.

In one embodiment, the engaging members comprise at least one first engaging element configured to be in contact with an annular protuberance of the neck, in the open position.

The friction which opposes free rotation of the retaining ring in the open position is generated between the first engaging element and the annular protuberance.

In a third aspect of the invention, there is provided a cap for a container comprising:

- a retaining ring intended to remain associated with a neck of the container, the retaining ring extending about a central axis;
- a closing element movable between a closed position and an open position;
- at least one connecting band for keeping the closing element connected to the retaining ring even in the open position;

wherein the retaining ring comprises engaging members suitable for engaging with the neck in order to prevent the retaining ring from being pulled off the neck, the engaging members comprising a plurality of first engaging elements and a plurality of second engaging elements each of which extends towards the inside of the retaining ring, the first engaging elements having a shape different from the second engaging elements, wherein each of the first engaging elements and each of the second engaging elements comprises:

- a retaining portion delimited by an abutment surface suitable for abutting against an annular protuberance of the neck for preventing the retaining ring from being removed from the neck;
- a centring portion which projects from the abutment surface for going into contact with the neck before the closing element is brought into the open position for the first time, so as to keep the corresponding retaining portion centred relative to the central axis;

and wherein each of the first engaging elements further comprises an anti-rotation appendage for contacting the neck in the open position, so as to obstruct rotation of the retaining ring around the neck, the centring portion being interposed between the retaining portion and the anti-rotation appendage.

In a fourth aspect of the invention, there is provided a combination of a cap for a container and of a container neck, wherein the cap comprises:

a retaining ring intended to remain associated with the neck, the retaining ring extending about a central axis;

a closing element movable between a closed position and an open position;

at least one connecting band for keeping the closing element connected to the retaining ring even in the open position;

wherein the retaining ring comprises engaging members suitable for engaging with the neck in order to prevent the retaining ring from being pulled off the neck, the engaging members comprising a plurality of first engaging elements and a plurality of second engaging elements distributed around the central axis, the first engaging elements having a shape different from the second engaging elements, wherein each of the first engaging elements comprises an anti-rotation appendage for contacting the neck in the open position, so as to obstruct rotation of the retaining ring around the neck.

The first engaging elements distributed around the central axis of the retaining ring ensure that, in the open position, between the retaining ring and the neck a friction is generated, which is sufficient to prevent the retaining ring from freely rotating around the neck.

The invention may be better understood and implemented with reference to the accompanying drawings, which illustrate an example, non-limiting embodiment of it, in which:

FIG. 1 is a perspective view of a cap ready to be applied on a container, the cap comprising a closing element and a retaining ring which are still joined to each other by a plurality of breakable bridges;

FIG. 2 is a side view of the cap of FIG. 1, applied to a container neck, in which the closing element is in a closed position and the breakable bridges are still intact;

FIG. 3 is a top view of the cap and of the neck of FIG. 2;

FIG. 4 is a cross-section, along the plane IV-IV of FIG. 3;

FIG. 7 is an enlarged view like that of FIG. 5, relating to a configuration in which the closing element is in the closed position and the breakable bridges have been broken;

FIG. 8 is an enlarged view like that of FIG. 6, in the configuration of FIG. 7;

FIG. 9 is a side view of the cap applied on the neck, in which the closing element is in the closed position and the breakable bridges are broken;

FIG. 10 is a perspective view of the cap applied on the neck, in which the closing element is in an open position.

Figure 5:
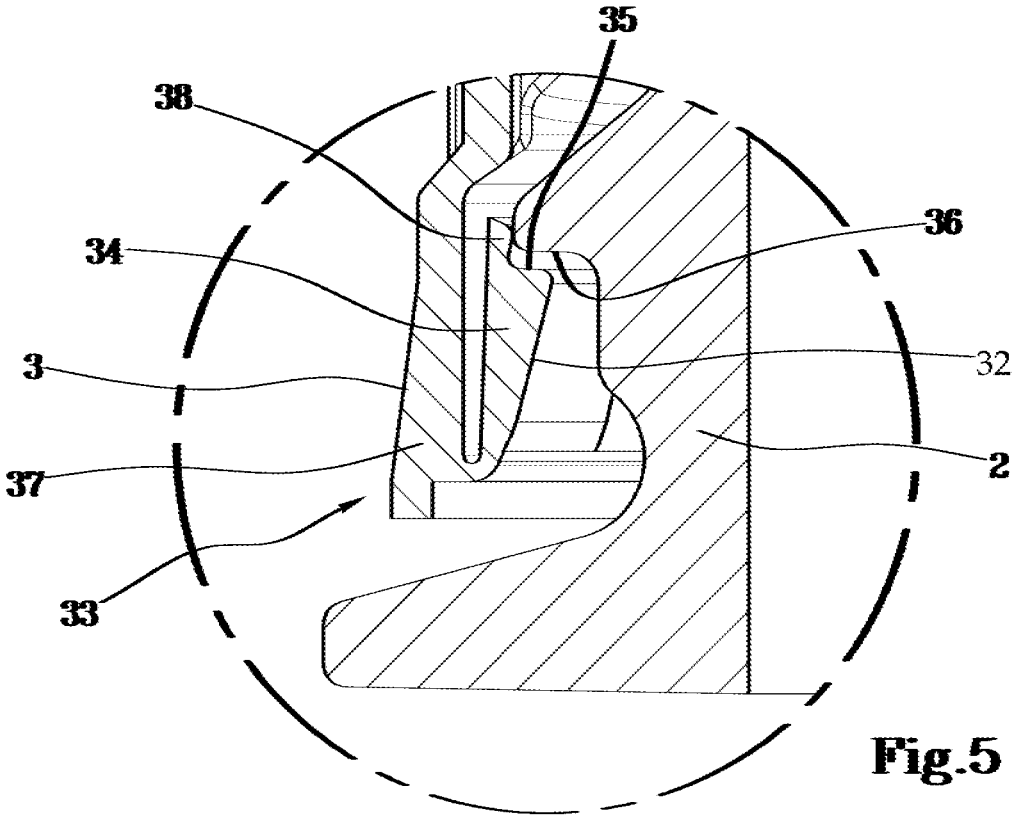
FIG. 5 is an enlarged view of the detail A of FIG. 4.

FIG. 1 shows a cap 1 for closing a container, in particular a bottle intended to contain a liquid substance such as a beverage. The cap 1 is made of polymeric material. Any polymeric material suitable for being moulded may be used to obtain the cap 1. In particular, the latter may be produced by injection moulding or compression moulding.

The cap 1 is shown in FIG. 2 in a configuration in which the cap 1 is applied to a neck 2 of the container. The container comprises a body which has not been shown in the Figures.

The cap 1 comprises a retaining ring 3 intended to remain anchored to the neck 2. The cap 1 further comprises a closing element 4 which may be shifted by a user between an open position and a closed position. As shown in FIG. 4, in the closed position, the closing element 4 closes an opening 5 surrounded by the neck 2, so that a substance contained in the container cannot come out. In the open position, the closing element 4 is away from the neck 2, so as to allow the substance present in the container to flow out.

The closing element 4 has a lateral wall 6 which extends around an axis Z, shown in FIG. 4. The closing element 4 further comprises a transversal wall 7 which extends transversally, in particular perpendicularly, to the axis Z, at one end of the lateral wall 6, so as to close that end. The transversal wall 7 may be flat, even if other shapes are theoretically possible. In the example shown, the transversal wall 7 has a substantially circular shape in plan view.

The transversal wall 7 is provided, on its inner surface, with a fixing arrangement, by which the closing element 4 can be removably fixed to the neck 2. The fixing arrangement may comprise, for example, an inner thread 10 intended to engage with an outer thread 11 made on the neck 2, as shown in FIG. 4.

The lateral wall 6 may be joined to the transversal wall 7 at a joining zone 8 which, in the example shown, is shaped as a rounded edge.

The lateral wall 6 may be provided with a plurality of knurling lines 9, distributed on an outer surface of the lateral wall 6 and parallel to the axis Z. In the example shown, the knurling lines 9 also extend in the joining zone 8. However, this condition is not necessary, since the knurling lines 9 may be absent from the joining zone 8.

The knurling lines 9 allow a user to grip the closing element 4 more securely in order to apply it on, or remove it from, the neck 2, in particular by screwing the closing element 4 onto the neck 2, and respectively unscrewing the closing element 4 from the neck 2. The knurling lines 9 also allow improved gripping of the cap 1 by a spindle of a capping machine, arranged for applying the cap 1 on the neck 2.

A sealing lip 12, shown in FIG. 4, may project from a surface of the transversal wall 7 facing towards the inside of the cap 1. The sealing lip 12, for example having an annular shape, is suitable for engaging with an inner surface of the neck 2 in order to prevent leaks of the substance contained in the container, or in order to prevent contaminations of that substance with external substances.

In the closed position, between the closing element 4 and the retaining ring 3 a separating line 14 is defined, shown in FIGS. 1 and 2, along which the closing element 4 is separable from the retaining ring 3.

The separating line 14 may be obtained by a cutting operation performed on the cap 1 after the latter has been extracted from the mould in which it has been formed.

The separating line 14 may extend in a plane which, in the closed position of the closing element 4, is arranged transversally, in particular perpendicularly, to the axis Z. However, this configuration is not necessary, and the separating line 14 may even extend on a surface which is not flat. Along the separating line 14 a plurality of breakable bridges 15 may be provided, suitable for being broken the first time the closing element 4 is brought into the open position, thereby signalling to the user if the container closed by the cap 1 has ever been opened.

The separating line 14 has a circumferential extent of less than 360° around the axis Z, so that between the closing element 4 and the retaining ring 3 a hinge structure 16 remains defined by which the closing element 4 remains connected to the retaining ring 3 even in the open position. More specifically, the closing element 4 may be moved between the open position and the closed position by a rotating or rotating-translating movement around the hinge structure 16.

In the example shown, the hinge structure 16 comprises two connecting bands 17, visible in FIGS. 2 and 10, which connect the closing element 4 to the retaining ring 3.

As shown in FIG. 2, one connecting band 17*a* of the two connecting bands 17 is defined between one end of the separating line 14 and an intermediate incision line 18. The latter is interposed between two ends of the separating line 14 and may comprise a first segment 19 aligned with the separating line 14, a second segment 20 nearer to the retaining ring 3 relative to the separating line 14, and a joining segment 21 which joins the first segment 19 to the second segment 20. The first segment 19 and the second segment 20 may lie in planes which are parallel to each other. The first segment 19 may lie in the same plane defined by the separating line 14. The joining segment 21 is positioned obliquely relative to the axis Z, so as to join the first segment 19 to the second segment 20. Therefore, the intermediate incision line 18 may have the shape of an "S" or a "Z". The connecting band 17*a* is defined between the end of the separating line 14 nearest the intermediate incision line 18 and the second segment 20 of the intermediate incision line 18.

The other connecting band 17*b* is defined between the intermediate incision line 18, more precisely the first segment 19 of the intermediate incision line 18, and a further incision line 22 which extends from a further end of the separating line 14. The further incision line 22 may comprise a segment 23 lying in a plane parallel to the plane defined by the separating line 14, for example in the same plane in which the second segment 20 lies. The further incision line 22 may further comprise a further segment 24 which joins the segment 23 to the separating line 18. The further incision line 22 may have the shape of an "L".

In the closed position of the closing element 4, the connecting bands 17 described above lie in a substantially horizontal position, if it is assumed that the container on which the cap 1 is applied is resting on a substantially horizontal resting surface. When the closing element 4 is shifted to the open position, the connecting bands 17 deform, moving away from the retaining ring 3, thereby allowing the closing element 4 to be removed from the neck 2 and if necessary arranged in a position in which the transversal wall 7 is facing towards the body of the container, as shown in FIG. 10.

The hinge structure 16 shown in FIGS. 2 and 10 is only an example of how the closing element 4 may be connected to the retaining ring 3. The closing element 4 may also be connected to the retaining ring 3 in other ways, for example by a hinge structure comprising a single connecting band, or comprising one or more connecting bands delimited by lines which extend parallel to the axis Z. In other words, the closing element 4 may be connected to the retaining ring 3 even by a hinge structure 16 different from that shown in FIGS. 2 and 10.

As shown in FIGS. 1 and 2, the lateral wall 6 of the closing element 4 and the retaining ring 3 define, in the closed position, a skirt 25 which extends around the axis Z. In the closed position, the retaining ring 3 is concentric with the lateral wall 6.

The skirt 25 may have a shape which is roughly cylindrical. In more detail, the skirt 25 may have a cylindrical portion, which comprises most of the lateral wall 6, and a flared portion, which extends towards a free edge 26 of the retaining ring 2. A step 27 may be interposed between the cylindrical portion and the flared portion of the skirt 25. In the example shown, the step 27 is made in the lateral wall 6 near the separating line 14.

The flared portion of the skirt 25 comprises the retaining ring 3 and possibly a small part of the lateral wall 6.

The retaining ring 3 is delimited by an outer surface 28 which may be substantially frustoconical.

As shown in FIG. 4, the neck 2 may comprise a collar 29 below which the body of the container, not shown, extends. The collar 29 may be arranged for engaging with a conveying element of a machine which processes the containers, for conveying the container inside the machine.

The neck 2 comprises an annular protuberance 30 which extends around a longitudinal axis of the neck 2 below the outer thread 10, more precisely in a position interposed between the outer thread 10 and the collar 29.

As shown in FIG. 4, the retaining ring 3 comprises engaging members suitable for engaging with the neck 2 for keeping the retaining ring 3 anchored to the neck 2, thereby preventing the retaining ring 3 from being removed from the neck 2 when the closing element 4 is brought into the open position. The engaging members comprise first engaging elements and second engaging elements which extend towards the inside of the retaining ring 3.

The first engaging elements may comprise at least one first engaging element 31, provided in an inner region of the retaining ring 3. More specifically, in the example shown a plurality of first engaging elements 31 is provided, which are distributed for example in a regular way, that is to say, angularly equally spaced, around a central axis Z1 of the retaining ring 3. In the closed position, the central axis Z1 of the retaining ring 3 coincides with the axis Z of the lateral wall 6.

The second engaging elements may comprise at least one second engaging element 32, more precisely a plurality of second engaging elements 32, which are arranged inside the retaining ring 3. The second engaging elements 32 may be distributed in a regular way, that is to say, angularly equally spaced, around the central axis of the retaining ring 3.

As shown in FIG. 1, the first engaging elements 31 and the second engaging elements 32 may be distributed around the central axis of the retaining ring 3 in an alternating way. In other words, each first engaging element 31 may be interposed between two second engaging elements 32 and vice versa.

Figure 6:
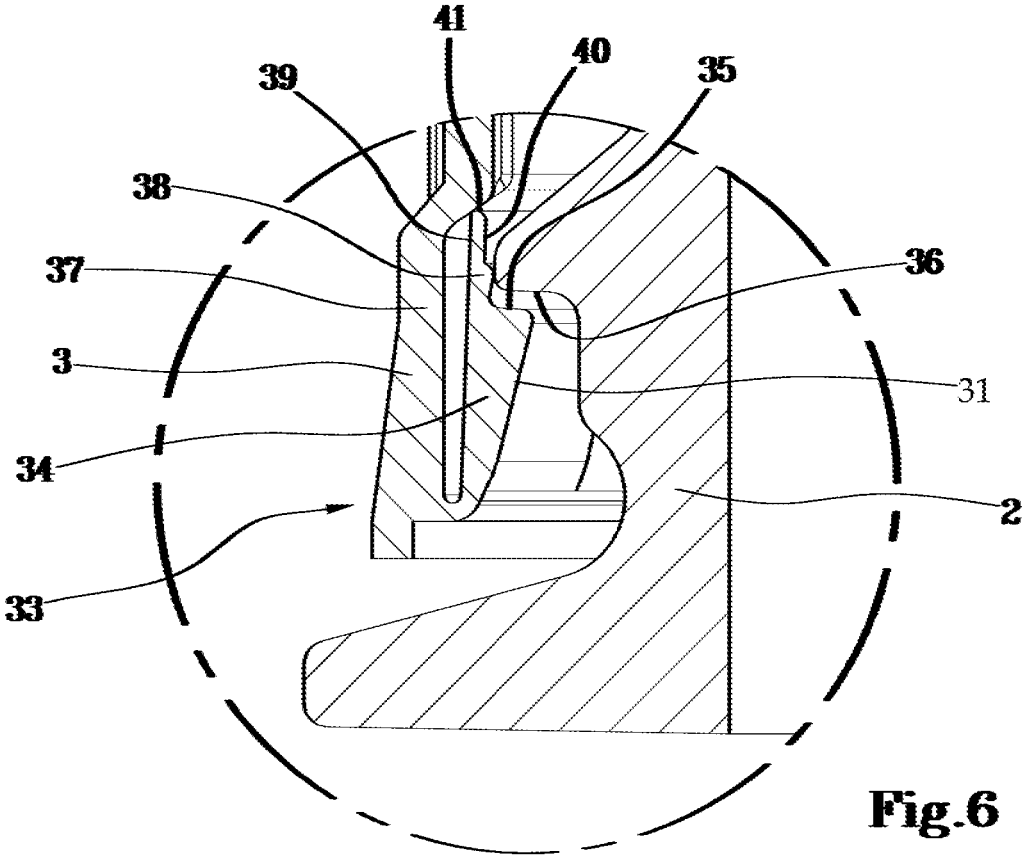
FIG. 6 is an enlarged view like that of FIG. 5, showing a detail of a cross-section along the plane VI-Vi of FIG. 3.

In the example shown, as is more clearly visible in FIGS. 5 and 6, the first engaging elements 31 and the second engaging elements 32 are shaped as respective tabs which extend towards the inside of the cap 1 from an edge region 33 of the retaining ring 3. The edge region 33 is arranged near the free edge 26, at the opposite side of the retaining ring 3 relative to the separating line 14. The tabs are bent towards the inside of the cap 1. In more detail, each tab has an anchoring end connected to a main body 37 of the retaining ring 3 in the edge region 33, and a free end, opposite to the anchoring end, facing towards the separating line 14.

The above-mentioned tabs are obtained by moulding in the same mould in which the other parts of the cap 1 are formed. When the cap 1 is extracted from the mould, the tabs may already be bent towards the inside of the cap 1, or they may at least partly extend outside the cap 1. In the latter case, the tabs are bent towards the inside of the cap 1 after the latter has been extracted from the mould, in a special bending machine.

As shown in FIGS. 5 and 6, both the first engaging elements 31 and the second engaging elements 32 may each comprise a retaining portion 34 suitable for keeping the retaining ring 3 associated with the neck 2. For that purpose, the retaining portion 34 is delimited by an abutment surface 35 suitable for abutting against the annular protuberance 30 of the neck 2. The abutment surface 35 is in particular suitable for abutting against a stop surface 36 which delimits the annular protuberance 30 towards the body of the container, that is to say, towards the collar 29.

The abutment surface 35 may be substantially flat. The abutment surface 35 extends transversally, for example perpendicularly, to the central axis Z1.

Also the stop surface 36 may be substantially flat. The stop surface 36 may extend transversally, in particular perpendicularly, to the central axis Z1. The retaining portion 34 is in particular configured to interact with the annular protuberance 30 when the closing element 4 is brought into the open position for the first time. When the user unscrews the closing element 4 to remove it from the neck 2, the closing element 4 starts to ascend along the neck 2 away from the body of the container. The retaining ring 3 is initially in the position of FIGS. 5 and 6, in which the retaining portion 34 is at a distance from the annular protuberance 30. The retaining ring 3, connected to the closing element 4 both by the connecting bands 17, and by the breakable bridges 15 (which are still intact) initially moves away from the body of the container together with the closing element 4. When the retaining portion 34 abuts against the annular protuberance 30, or more precisely the abutment surface 35 abuts against the stop surface 36, the retaining ring 3 can no longer move away from the body of the container. Since, in contrast, the closing element 4 continues to be unscrewed, the breakable bridges 15 are subjected to a tensile stress which causes them to break. That makes it possible to completely unscrew the closing element 4 from the neck 3 and then rotate the closing element 4 to bring it into the open position.

If moreover, when the closing element 4 is brought into the open position again after it has been applied on the neck 2 again, the closing element 4 is excessively pulled upwards (that is to say, away from the body of the container), the retaining portion 34 again abuts against the annular protuberance 30, thereby preventing the retaining ring 3 from being removed from the neck 2 and therefore preventing the cap 1 from being completely separated from the container.

The retaining portion 34 may have a substantially triangular shape. In particular, the retaining portion 34 may roughly have the shape of an inverted right-angled triangle. One vertex of the triangle is connected to the main body 37 of the retaining ring 3 at the anchoring end, whilst a base of the triangle defines the abutment surface 35.

The first engaging elements 31 and the second engaging elements 32 may further comprise a centring portion 38, which from the retaining portion 34 projects towards the separating line 14. The centring portion 38 is suitable for engaging with the neck 2, in particular with the annular protuberance 30, before the closing element 4 is separated from the retaining ring 3 by breaking the breakable bridges 15. The centring portion 38 has a centring function, since it allows the retaining portion 34 to be kept centred relative to the neck 2 before the closing element 4 is brought into the open position for the first time. The centring portion 38 also has an anti-tipping function because it prevents the retaining portion 34 from "tipping over", that is to say, from rotating towards the neck 2 around the anchoring end of the corresponding tab. If that were to occur, when the closing element 4 is unscrewed for the for the first time, the retaining portion 34 could inappropriately engage with the neck 2, for example without abutting against the stop surface 36, and consequently breakage of the breakable bridges 15 would not be guaranteed.

The centring portion 38 may be configured to engage with a lateral surface of the annular protuberance 30 facing the opposite way relative to the central axis of the retaining ring, that is to say, facing outwards from the neck 2. At that surface, the external diameter of the annular protuberance 30 may be at its maximum.

The centring portion 38 may have, in a radial direction, an average thickness less than the average thickness of the retaining portion 34.

The radial thickness of the centring portion 38 may increase going from the retaining portion 34 towards the closing element 4, in such a way that the centring portion 38 is delimited by an inclined surface facing the annular protuberance 30, said surface being inclined towards the annular protuberance 30.

The first engaging elements 31 further each comprise an anti-rotation appendage 39 suitable for obstructing rotation of the retaining ring 3, and consequently of the closing element 4 connected to it, around the neck 2, when the closing element 4 is in the open position. For that purpose, the anti-rotation appendage 39 is configured to couple by friction with the neck 2, for example with annular protuberance 30, when the closing element 4 is in the open position. The friction which develops between the anti-rotation appendage 39 and the neck 2 makes it difficult for the cap 1 to freely rotate around the neck 2, for example under the action of only the force of gravity. The anti-rotation appendage 39, shown in detail in FIGS. 6 and 8, projects towards the closing element 4 at the free end of the first engaging element 31, that is to say, at the opposite end to the anchoring end where the first engaging element 31 is joined to the main body 37 of the retaining ring 3. In the example shown, the anti-rotation appendage 39 projects from the centring portion 38 towards the closing element 4

The anti-rotation appendage 39 is delimited by an inner surface 40 which, in use, is facing towards the neck 2. The inner surface 40 may be a cylindrical surface coaxial with the central axis Z1 of the retaining ring 3. More precisely, the inner surface 40 may have a cylindrical shape when the anti-rotation appendage 39 engages with the neck 2.

The anti-rotation appendage 39 further has an end 41, which may be rounded in a region facing the neck 2. The end 41 delimits the anti-rotation appendage 39 on the opposite side relative to the centring portion 38.

In the example shown, the anti-rotation appendage 39 has a thickness, measured in a radial direction relative to the central axis of the retaining ring 3, which is less than the radial thickness of the centring portion 38. However, this condition is not necessary and the radial thickness of the anti-rotation appendage 39 could even be equal to the radial thickness of the centring portion 38.

In the example shown, as is visible in FIG. 1, the anti-rotation appendage 39 substantially has the same angular amplitude as the retaining portion 34 and the centring portion 38, around the central axis Z1 of the retaining ring 3. However, this condition is not necessary and, in an alternative embodiment not shown, the angular amplitude of the anti-rotation appendage 39 could be less than that of the centring portion 38.

The second engaging elements 32 do not comprise the anti-rotation appendage 39, i.e. each second engaging element 32 is free of the anti-rotation appendage 39. Consequently, each first engaging element 31 extends towards the separating line 14, that is to say, towards the closing element 4, more than each second engaging element 32. In other words, the first engaging element 31 has an axial length, measured along a direction parallel to the central axis Z1 of the retaining ring 3, greater than the axial length of the second engaging element 32.

After it has been produced inside a mould, the cap 1 may be subjected to successive operations, for example cutting operations, by which it is possible to obtain the separating line 14 and, if present, the intermediate incision line 18 and the further incision line 22. Moreover, the cap 1 may be subjected to bending operations intended to bend towards the inside the tabs which define the engaging elements 31, 32, if the latter have not been formed in a position already bent towards the inside of the cap 1.

At this point, the cap 1 may be applied to the neck 2 of the container, already filled with the desired substance, by a traditional capping machine.

After having been applied on the neck 2, the cap 1 is in the configuration shown in FIG. 1, and the first engaging elements 31 and the second engaging elements 32 are respectively in the position shown in FIGS. 6 and 5. The closing element 4 is arranged in the closed position and is joined to the retaining ring 3 by the breakable bridges 15, which are still intact.

As shown in FIGS. 6 and 5, the retaining portion 34 both of the first engaging elements 31 and of the second engaging elements 32 is at a distance from the neck 2, in particular from the annular protuberance 30. In more detail, the abutment surface 35 is not in contact with the stop surface 36.

The anti-rotation appendage 39 of the first engaging elements 31 is not in contact with the neck 2. In particular, the anti-rotation appendage 39 is at a distance from annular protuberance 30, as shown in FIG. 6.

In contrast, the centring portion 38 both of the first engaging elements 31 and of the second engaging elements 32 is in contact with the neck 2, in particular with the annular protuberance 30. In more detail, the centring portion 38 is in contact with the lateral surface of the annular protuberance 30, for example in a maximum diameter zone of the annular protuberance 30.

By engaging with the annular protuberance 30, the centring portion 38 keeps the corresponding retaining portion 34 in a centred position relative to the central axis Z1. In particular, this prevents the retaining portion 34 from tilting excessively towards the central axis Z1, by rotating around the anchoring end at which the corresponding engaging element 31 or 32 is joined to the main body 37 of the retaining ring 3. In this way, the retaining portion 34 is kept in a position suitable for allowing subsequent breakage of the breakable bridges 15.

When the user wants to open the container to which the cap 1 is applied for the first time, the closing element 4 is gripped, in particular at the lateral wall 6, and rotated around the longitudinal axis of the neck 2 to unscrew the closing element 4 from the neck 2. The closing element 4 consequently moves around the neck 2 along a helical path, determined by a rotation in an unscrewing direction around the neck 2 and by a translation along the longitudinal axis of the neck 2 away from the body of the container.

In an initial step, the retaining ring 3, still joined to the closing element 4 by the breakable bridges 15, moves together with the closing element 4, thereby rotating around the neck 2 and simultaneously moving away from the body of the container. By doing that, each anchoring portion 34 moves towards the annular protuberance 30, until the abutment surface 35 of the anchoring portion 34 abuts against the stop surface 36 of the annular protuberance 30. When that happens, the retaining ring 3 can no longer move along the neck 2 away from the body of the container. In contrast, the closing element 4 continues to be unscrewed by the user and therefore to ascend along the neck 2 (assuming that the container closed by the cap 1 is resting on a substantially horizontal surface, so that the neck 2 is facing upwards). In this way, the breakable bridges 15 are pulled, that is to say, they are subjected to a tensile stress which initially deforms them, and then breaks them. The closing element 4 thereby separates from the retaining ring 3 along the separating line 14, but remains joined to the retaining ring 3 at the hinge structure 16, in particular owing to the connecting bands 17. Continuing to rotate the closing element 4, the connecting bands 4 deform by bending outwards from the cap 1 and they move away from the retaining ring 3. The closing element 4 is gradually unscrewed from the neck 2, until it completely disengages from the latter. The closing element 4 may now be moved away from the neck 2 in order to easily access the substance contained in the container, which can be drunk by the user directly from the neck 2, or poured into a glass or other container.

When the closing element 4 has been disengaged from the neck 2, the closing element 4 remains anchored to the neck 2 owing to the connecting bands 17. The latter allow the closing element 4 to be rotated in a direction transversal to the longitudinal axis of the neck 2, so that the closing element 4 can be brought, for example, into the position shown in FIG. 10, in which the transversal wall 7 is facing towards the body of the container and a cavity defined inside the closing element 4 is facing upwards.

The first engaging elements 31, which project upwards more than the second engaging elements 32 are visible in FIG. 10. In particular, the first engaging elements 31 project beyond the separating line 14 more than the second engaging elements 32.

At the end of use, the user repositions the closing element 4 on the neck 2 and screws the closing element tight to return it to the closed position.

At this point, the cap 1 is in the configuration shown in FIG. 9, in which the closing element 4 is in the closed position and the breakable bridges 15 are broken. The retaining ring 3, connected to the closing element 4 only by the hinge structure 16, has descended along the neck 2 due to the effect of the force of gravity. Consequently, the retaining ring 3 is at a distance from the closing element 4 along the separating line 14, even though it is still facing the closing element 4. As shown in FIGS. 7 and 8, the retaining ring 3 may be rested on the collar 29 along the free edge 26. Therefore, the collar 29 acts as a stop for the retaining ring 3, preventing a further downward movement of the retaining ring 3.

As shown in FIG. 8, when the closing element 4 is returned to the closed position after the first opening, the anti-rotation appendage 39 of the first engaging elements 31 makes contact with the neck 2, in particular with the annular protuberance 30. In the example shown, the end 41 of the anti-rotation appendage 39 is in contact with the annular protuberance 30 in a maximum diameter region of the latter. In contrast, the retaining portion 34 and the centring portion 38 of each first engaging element 31 are at a distance from the neck 2.

As shown in FIG. 7, when the closing element 4 is returned to the closed position after the first opening, the second engaging elements 32 are at a distance from the neck 2, that is to say, they do not interact with the neck 2. In particular, neither the retaining portion, 34 nor the centring portion 38 are in contact with the neck 2.

This arrangement of the first engaging elements 31 and of the second engaging elements 32 is also kept when the closing element 4 is brought into the open position.

Therefore, in the open position, between the first engaging elements 31 and the neck 2 (in particular between the anti-rotation appendage 39 of the first engaging elements 31 and the annular protuberance 30 of the neck 2) a degree of friction develops, which obstructs rotation around the neck 2 by the retaining ring 3 and consequently by the closing element 4 anchored to it. Owing to that friction, free rotation of the cap 1 around the neck 2, for example due to the effect of the force of gravity alone, becomes difficult. This considerably reduces, or even eliminates, the risk that, if the user is drinking directly from the neck 2, the closing element 4 will strike the face of the user. If, in contrast, the user is pouring the substance contained in the container into a glass or into another container, it becomes difficult for the closing element 4 to position itself between the neck 2 and the glass, obstructing the supply of the substance into the glass through the neck 2. Since, when the closing element 4 is in the open position and/or is returned to the closed position, the second engaging elements 32 are not in contact with the neck 2, the generation of excessive friction between the retaining ring 3 and the neck 2 is avoided.

In an alternative embodiment, the first engaging elements 31 and the second engaging elements 32 could not be shaped as individual tabs as shown in the drawings. For example, the first engaging elements and the second engaging elements could be different portions of a single tab, which is bent towards the inside of the cap, which extends continuously around the central axis of the retaining ring. Alternatively, the first engaging elements and the second engaging elements could be shaped as respective projections which project from an inner surface of the retaining ring, rather than as bent tabs.

In an alternative embodiment, along the separating line 14, rather than the breakable bridges 15, there could be a single membrane which is less thick than the skirt 25, and which is intended to break the first time the closing element 4 is brought into the open position.

In any case, what is obtained is a cap whose production is not more complicated than traditional caps, and which may be less inconvenient to use, chiefly owing to the angularly stable position of the retaining ring.

The invention claimed is:

1. A cap for a container comprising:

a retaining ring intended to remain associated with a neck of the container, the retaining ring extending about a central axis;

a closing element movable between a closed position and an open position;

at least one connecting band for keeping the closing element connected to the retaining ring even in the open position;

wherein the retaining ring comprises engaging members suitable for engaging with the neck in order to prevent the retaining ring from being pulled off the neck, the engaging members comprising a plurality of first engaging elements and a plurality of second engaging elements distributed around the central axis, the first engaging elements having a shape different from the second engaging elements, wherein each of the first engaging elements and each of the second engaging elements extends towards the inside of the retaining ring and comprises:

a retaining portion delimited by an abutment surface suitable for abutting against an annular protuberance of the neck for preventing the retaining ring from being removed from the neck;

a centring portion which projects from the abutment surface for engaging with the neck before the closing element is brought into the open position for the first time, so as to keep the retaining ring centred relative to the neck;

and wherein each of the first engaging elements further comprises an anti-rotation appendage for contacting the neck in the open position, so as to obstruct rotation of the retaining ring around the neck, the centring portion being interposed between the retaining portion and the anti-rotation appendage.

2. A cap according to claim 1, wherein the first engaging elements and the second engaging elements are distributed around the central axis in an alternating manner, so that each first engaging element is interposed between two second engaging elements and vice versa.

3. A cap according to claim 1, wherein the abutment surface is substantially flat and extends transversely to the central axis.

4. A cap according to claim 1, wherein the centring portion has, in a radial direction, an average thickness less than the average radial thickness of the retaining portion.

5. A cap according to claim 1, wherein the retaining portion has, in a cross-section, a substantially triangular shape.

6. A cap according to claim 1, wherein the second engaging elements are configured to remain at a distance from the neck in the open position.

7. A cap according to claim 1, wherein the first engaging elements extend from the retaining ring towards the closing element more than the second engaging elements.

8. A cap according to claim 1, wherein the retaining ring and the closing element are separable from each other along a separating line, a plurality of breakable bridges being provided along the separating line, the breakable bridges being intended to break the first time the closing element is brought into the open position.

9. A cap according to claim 1, wherein the anti-rotation appendage is delimited by a substantially cylindrical inner surface.

10. A cap according to claim 1, wherein the anti-rotation appendage is arranged in a position nearer to the closing element than the retaining portion.

11. A cap according to claim 1, wherein the first engaging elements and the second engaging elements are shaped as respective tabs which extend from an edge region of the retaining ring arranged at the opposite side of the retaining ring relative to the closing element, said respective tabs being bent towards the inside of the retaining ring.

12. A cap according to claim 1, wherein the second engaging elements are shorter than the first engaging elements.

13. A cap according to claim 1, wherein the anti-rotation appendage projects from the centring portion towards the closing element and has a free end in a region thereof opposite to the centring portion.

14. A combination of a cap for a container and a container neck, wherein the cap comprises:

a retaining ring intended to remain associated with the neck, the retaining ring extending about a central axis;

a closing element movable between a closed position and an open position;

at least one connecting band for keeping the closing element connected to the retaining ring even in the open position;

wherein the retaining ring comprises engaging members suitable for engaging with the neck in order to prevent the retaining ring from being pulled off the neck, the engaging members comprising a plurality of first engaging elements and a plurality of second engaging elements distributed around the central axis, the first engaging elements having a shape different from the second engaging elements, wherein each of the first engaging elements comprises an anti-rotation appendage for contacting the neck in the open position, so as to obstruct rotation of the retaining ring around the neck.

15. A combination according to claim 14, wherein the anti-rotation appendage is configured to remain at a distance from the neck before the closing element is brought into the open position for the first time.

16. A combination according to claim 14, wherein the second engaging elements are configured to remain at a distance from the neck in the open position.

17. A combination according to claim 14, wherein each of the first engaging elements and each of the second engaging elements extends towards the inside of the retaining ring and comprises:

a retaining portion delimited by an abutment surface suitable for abutting against an annular protuberance of the neck for preventing the retaining ring from being removed from the neck;

a centring portion which projects from the abutment surface for engaging with the neck before the closing element is brought into the open position for the first time, so as to keep the retaining ring centred relative to the neck;

and wherein in each of the first engaging elements the centring portion is interposed between the retaining portion and the anti-rotation appendage.

18. A combination according to claim 17, wherein, in the open position, the anti-rotation appendage of each of the first engaging elements is in contact with the annular protuberance and wherein, in the open position, the centring portion of the first engaging elements and of the second engaging elements is at a distance from the annular protuberance.

19. A combination according to claim 17, wherein the abutment surface of the first engaging elements and of the second engaging elements is configured to abut against a stop surface which delimits the annular protuberance towards a main body of the container, the centring portion of the first engaging elements and of the second engaging elements being configured to engage with a side surface of the annular protuberance.

* * * * *